US006911906B2

(12) United States Patent
Satou

(10) Patent No.: US 6,911,906 B2
(45) Date of Patent: Jun. 28, 2005

(54) DATA PROCESSING SYSTEM FOR STRICT MANAGEMENT OF PRIVATE INFORMATION

(75) Inventor: Akinori Satou, Minato-ku (JP)

(73) Assignee: NEC Corporation, Tokyo (JP)

( * ) Notice: Subject to any disclaimer, the term of this patent is extended or adjusted under 35 U.S.C. 154(b) by 95 days.

(21) Appl. No.: 10/671,728

(22) Filed: Sep. 29, 2003

(65) Prior Publication Data

US 2004/0068555 A1 Apr. 8, 2004

(30) Foreign Application Priority Data

Oct. 3, 2002 (JP) ..... 2002-291079

(51) Int. Cl.[7] ..... G08B 23/00

(52) U.S. Cl. ..... 340/500; 340/905; 340/933; 340/988; 340/539.1; 340/539.13

(58) Field of Search ..... 340/905, 933, 340/936, 988, 989, 991, 992, 993, 539.1, 539.13

(56) References Cited

U.S. PATENT DOCUMENTS 6,426,709 B1 * 7/2002 Becker et al. ..... 340/992
6,518,881 B2 * 2/2003 Monroe ..... 340/539.1
6,853,910 B1 * 2/2005 Oesterling et al. ..... 701/207

FOREIGN PATENT DOCUMENTS

JP 2002-117184 A 4/2002

* cited by examiner

*Primary Examiner*—Daryl C Pope
(74) *Attorney, Agent, or Firm*—Sughrue Mion, PLLC

(57) ABSTRACT

The data processing system of the present invention is provided with a center server that, upon receiving mobile data and mobile unit identifier from a portable information terminal, transmits edited data that are produced from the mobile data, a server identifier that is the transmission destination, and a mobile unit identifier to the outside by way of a communication network, and is also provided with a separate verification server. The verification server stores private information in advance, and transmits by way of a communication line directly to transmission destinations private information that matches with the mobile unit identifier that is received from the center server, whereby the danger of disclosing private information on the communication network can be reduced.

9 Claims, 3 Drawing Sheets

DATA PROCESSING SYSTEM FOR STRICT MANAGEMENT OF PRIVATE INFORMATION

BACKGROUND OF THE INVENTION

1. Field of the Invention

The present invention relates to a data processing system and data processing method for collecting and editing data that have been obtained by mobile sensors provided in mobile units such as automobiles and motorcycles, and distributing to facilities that use these data to provide information.

2. Description of the Related Art

In the prior art, a data processing system for processing data that have been obtained by mobile sensors includes: a center server for collecting and editing data that have been obtained from each mobile unit by mobile sensors; and an information provider server for accepting the distribution of data from the center server and providing information (for an example, refer to Japanese Patent Laid-Open Publication No. 117184/2002). The mobile sensors detect information relating to the mobile unit such as the vehicle position, speed, and brake control signals of the mobile unit as well as information on the environment such as the ambient temperature and ambient humidity of the mobile unit at prescribed time intervals. In the following explanation, information relating to the mobile unit and to the environment is referred to as "mobile data". In addition to the above-described mobile data, information handled by the center server includes private information, which is information that the owner of a mobile unit wishes to keep concealed. Private information includes information such as a mobile unit identifier for specifying the mobile unit of an owner. The mobile unit identifier is, for example, a telephone number or an email address.

We first refer to FIG. 1, which is a block diagram showing an example of a data processing system of the prior art, to describe the details of the data processing system of the prior art. As shown in FIG. 1, this data processing system includes: mobile sensor 10 that is provided in a mobile unit; portable information terminal 110 that is provided in the mobile unit and that is connected to mobile sensor 10 so as to allow communication; the above-described center server 122; first information provider server 132 that uses the mobile data for information that is to be provided; and second information provider server 142 that uses private information and mobile data to provide information to the mobile unit owner. These servers are connected by means of communication network 100 such as the Internet so as to allow mutual communication.

Further, as shown in FIG. 1, first information provider server 132 is provided in first information provider facility 130, and second information provider server 142 is provided in second information provider facility 140. Portable information terminal 110 stores information such as mobile unit identifiers that differ for each mobile unit. Portable information terminal 110 is further equipped with a wireless communication means such as a portable telephone that allows connection to communication network 100 by way of base station 150. Portable information terminal 110, upon receiving mobile data from mobile sensors 10, transmits mobile data and a mobile unit identifier to center server 122 by way of communication network 100.

Center server 122 saves private information that has been registered in advance by the mobile unit owner. Upon receiving a mobile unit identifier and mobile data from each portable information terminal 110, center server 122 edits the collected mobile data to create edited data. Center server 122 also reads out private information with the received mobile unit identifier as a search condition. Center server 122 further transmits edited data and private information that have been read in response to requests from second information provider server 142, and transmits edited data in response to requests from first information provider server 132. In addition, information that is requested by first information provider server 132 and second information provider server 142 is registered in advance in a program that is executed in center server 122.

Upon receiving edited data and private information from center server 122, second information provider server 142 compares the content of the private information and the edited data, and when it determines that information relating to the private information is included in the edited data, reads the mobile unit identifier from the private information and transmits the relevant information to portable information terminal 110 that is specified by the mobile unit identifier.

Upon receiving edited data, first information provider server 132 processes the edited data to a state that allows viewing by way of communication network 100 and makes the data accessible from unspecified information terminals (not shown in the figure).

However, the above-described prior art has the following drawbacks:

In order to transmit edited data and private information to a plurality of second information provider servers in response to the request of each server, the center server must both reserve a high degree of information security for protecting the private information and must edit and distribute a large volume of many types of data.

If, on the other hand, the second information provider servers that provide various services save the private information and the center server does not save private information, the private information is managed at a plurality of information provider facilities and the management of the private information is therefore more complex, raising the danger of unintended disclosure or unintended use.

In addition, managing private information at a plurality of information provider facilities in this way also raises the concern that the owners of mobile units will be aware of the above-described dangers and that many users will therefore refuse to provide private information.

SUMMARY OF THE INVENTION

The present invention was developed to solve the above-described problems of the prior art and therefore has as an object the provision of a data processing system and a data processing method that are capable of collecting and editing information relating to mobile units and further, of strictly managing private information.

In order to achieve the above-described objects, the data processing system of the present invention includes:

portable information terminals that are provided in mobile units for transmitting, to the outside by way of a communication network, mobile data detected by mobile sensors that are provided in the mobile units, and mobile unit identifiers;

a center server for saving in advance server identifiers for specifying transmission destinations of information, and for, upon receiving mobile data and mobile unit identifiers from the portable information terminals, transmitting edited data that have been produced from mobile data by the center server, server identifiers that are the transmission destinations of this edited data, and mobile unit identifiers; and a verification server for storing in advance private information that includes mobile unit identifiers, and for, upon receiving edited data, a server identifier, and a mobile unit identifier from the center server, transmitting private information that is specified by matching between the received mobile unit identifiers and mobile unit identifiers that are included in the private information and edited data to transmission destinations that are specified by the server identifiers by way of a communication line.

In the present invention as described above, the verification server stores private information in advance, and, sends directly to the transmission destination by way of a communication line private information for which matching occurs with the mobile unit identifier that has been received from the center server. As a result, the danger of disclosing private information to the communication network can be reduced.

In this case, in the data processing system of the present invention as described above, the mobile data may include information of the vehicle position and speed of the mobile unit; the edited data may include information of the vehicle position and the speed; the private information may include information of a route that has been registered by the owner of the mobile unit; and an information provider server that is the transmission destination that is specified by the server identifier may be provided for storing map information in advance, and for, upon receiving edited data and specified private information from the verification server, transmitting by way of the communication network to the portable information terminal that corresponds to the mobile unit identifier that is included in the specified private information, of condition information obtained by writing information of the vehicle position and speed that has been read from the edited data to the map information, condition information that pertains to the registered route that is included in the specified private information.

In the present invention as described above, the owner of a mobile unit, by registering information of a prescribed route in the verification server in advance, can not only obtain condition information regarding the registered route by the portable information terminal but can also, in comparison with the prior art, reduce the danger of disclosing information of the registered route to the communication network.

In addition, in the above-described data processing system of the present invention, the mobile data may include information on the vehicle position of a mobile unit; the edited data may include information of the vehicle position; the private information may include information on objects of interest of the owner of the mobile unit such as his or her likes, interests, hobbies, and pastimes; and an information provider server that is the transmission destination that is specified by a server identifier may be provided for: storing map information in advance; upon receiving the edited data and specified private information from the verification server, reading from the map information location information of sites that deal with the objects of interest that have been read from the specified private information and that are within a prescribed distance from the vehicle position that has been read from the edited data; and transmitting this location information by way of the communication network to the portable information terminal that is identified by the mobile unit identifier that is included in the specified private information.

In the present invention according to the foregoing description, the owner of a mobile unit, by registering his or her own objects of interest in advance, can not only acquire in the portable information terminal the location information of sites that deal with the objects of his or her interests at each destination of the mobile unit, but can also, compared to the prior art, reduce the danger of disclosing information regarding his or her interests on the communication network.

Further, in the above-described data processing system of the present invention, the mobile data may include information of the vehicle position of the mobile unit as well as information on damage such as a theft or an accident that has occurred in the mobile unit; the edited data may include the information of the vehicle position and the information on damage; the private information may include information on the name of the owner of the mobile unit; and an information provider server that is the transmission destination that is specified by a server identifier may be provided for storing in advance contact information of a prescribed facility that must be contacted in the event of damage; and, upon receiving the edited data and specified private information from the verification server, reporting to the prescribed facility information of the vehicle position that has been read from the edited data and information on names that has been read from the specified private information.

In the present invention according to the foregoing description, the owner of a mobile unit, by registering his or her name in the verification server in advance, can not only more quickly report his or her name to the necessary facility in the event of a mishap such as a theft or accident to the mobile unit, but can also, in comparison with the prior art, reduce the danger of disclosing his or her name to the communication network.

To achieve the above-described objects, the data processing method of the present invention is realized by a data processing system that includes portable information terminals that are provided in mobile units and a center server that is connected to these portable information terminals by way of a communication network so as to allow communication; the data processing system is further provided with a verification server that is connected to the center server by way of the communication network for storing in advance private information that includes mobile unit identifiers of the mobile units; and the data processing method comprises: storing in the center server server identifiers for specifying the transmission destinations of edited data; upon receiving from the portable information terminals mobile data, which is detected by mobile sensors that are provided in the mobile units, and mobile unit identifiers of mobile units, preparing edited data from the mobile data; transmitting these edited data, server identifiers that are the transmission destinations of the edited data, and the mobile unit identifiers to the verification server; and upon receiving the edited data, server identifiers, and mobile unit identifiers from the center server, transmitting by way of a communication line to the transmission destinations that are specified by the server identifiers edited data and private information that is specified by matching between the received mobile unit identifiers and the mobile unit identifiers that are contained in the private information.

In the above-described data processing method of the present invention, the mobile data may include information of the vehicle position and speed of a mobile unit, the edited data may include information of the vehicle position and the speed, the private information may include information on a route that has been registered by the owner of the mobile unit, and an information provider server that is the transmission destination that is specified by a server identifier may be provided for storing map information in advance. The information provider server may then, upon receiving specified private information and edited data from the verification server, transmit by way of the communication network to the portable information terminal identified by the mobile unit identifier that is contained in the specified private information, of condition information obtained by writing information on the vehicle position and speed that has been read from the edited data into the map information, condition information that pertains to the route that was registered and that is included in specified private information.

In addition, in the data processing method of the above-described present invention, the mobile data may include information of the vehicle position of a mobile unit; the edited data may include the information of the vehicle position; the private information may include information of objects of interest of the owner of a mobile unit such as likes, interests, hobbies and pastimes; an information provider server that is the transmission destination that is specified by a server identifier may be provided for storing map information in advance; and the information provider server may, upon receiving the edited data and specified private information from the verification server, read from the map information location information of sites that deal with the objects of interest that have been read from the specified private information and that are within a prescribed distance from the vehicle position that is read from the edited data, and transmit these location data by way of the communication network to the portable information terminal identified by the mobile unit identifier that is contained in the specified private information.

Further, in the above-described data processing method of the present invention, the mobile data may include the vehicle position of the mobile unit as well as information on damage such as a theft or an accident that has occurred in the mobile unit; the edited data may include the vehicle position and the information on damage; the private information may include information on the name of the owner of the mobile unit; and an information provider server that is the transmission destination that is specified by the server identifier may be provided for storing in advance contact information of a prescribed facility that must be contacted in the event of damage. Upon receiving the edited data and specified private information from the verification server, the information provider server may report to the prescribed facility the vehicle position that has been read from the edited data and the name information that has been read from the specified private information.

The present invention provides the following effects:

In the present invention, private information is managed by a verification server that is distinct from the center server that collects and edits mobile data, and the center server is therefore relieved of the burden for information security.

In addition, the verification server delivers private information directly to the information provider server, and the danger of disclosing private information to the communication network can therefore be reduced.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 1:
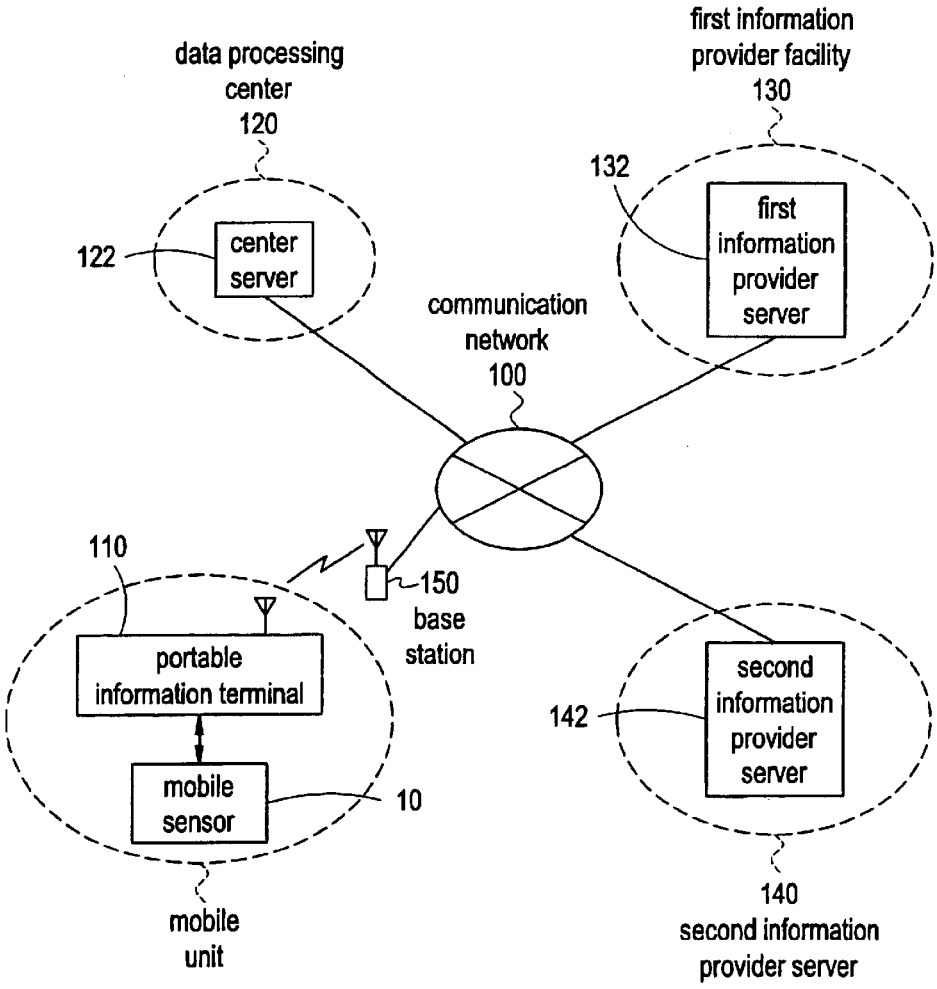
FIG. 1 PRIOR ART
FIG. 1 is a block diagram showing an example of a data processing system of the prior art.

The data processing system of the present invention provides: a center server that collects, edits, and distributes mobile data from mobile units; an information provider server that uses these data to provide services to owners of the mobile units; and a separate server for managing private information. The data processing system of the present invention thus enables protection of privacy when mobile data are distributed to the information provider server.

In the following explanation of an embodiment of the present invention, the same reference numerals are applied to the elements that are identical to the elements of the prior art.

Figure 2:
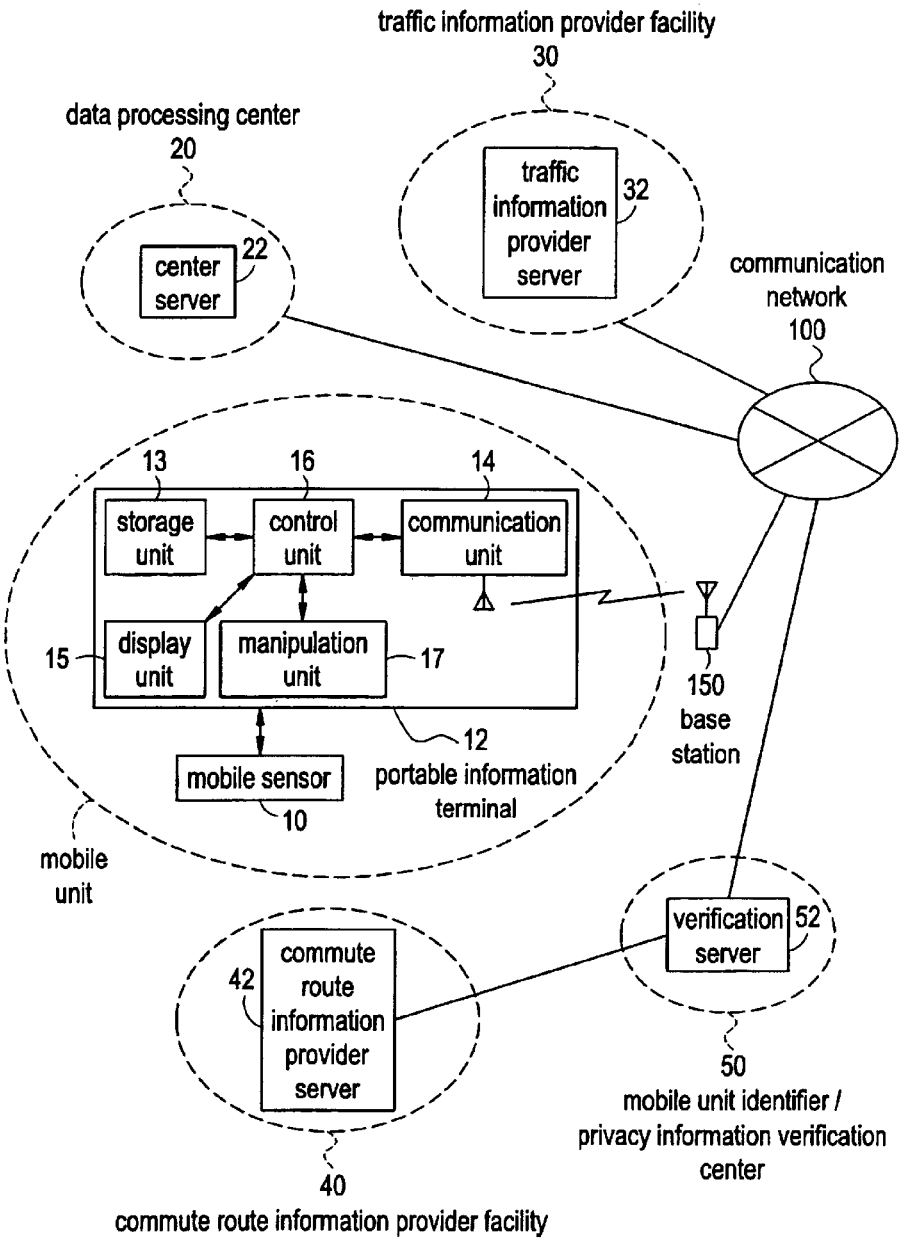
FIG. 2 is a block diagram showing an embodiment of the data processing system of the present invention.

FIG. 2 is a block diagram showing an embodiment of the data processing system of the present invention. As shown in FIG. 2, the data processing system of the present embodiment includes: mobile sensor 10 provided in an automobile, which is the mobile unit; portable information terminal 12 provided in the automobile and connected to mobile sensor 10 so as to allow communication; center server 22 for collecting and editing mobile data from each automobile; traffic information provider server 32, which is the first information provider server, that uses the mobile data to provide information; commute route information provider server 42, which is the second information provider server, that uses private information and mobile data to provide information to mobile unit owners; and verification server 52 for checking mobile unit identifiers with private information. Center server 22, traffic information provider server 32, and verification server 52 are connected so as to allow mutual communication by means of communication network 100 such as the Internet. Verification server 52 and commute route information provider server 42 are further connected so as to allow mutual communication by means of a communication line.

Portable information terminal 12 includes: storage unit 13 for saving mobile unit identifiers and mobile data; communication unit 14 that is equipped with wireless communication means for transmitting information to and receiving information from the outside by way of communication network 100; display unit 15 for displaying information that is transmitted and received by communication unit 14; control unit 16 for controlling storage unit 13, communication unit 14, and display unit 15; and manipulation unit 17 for input of instructions to control unit 16 by the mobile unit owner.

Portable information terminal 12 is capable of transmitting and receiving telephone calls and transmitting and receiving email by way of communication unit 14.

Control unit 16 includes a processor (not shown in the figure) for executing prescribed processing under the control of programs and a memory (not shown in the figure) for storing programs. Control unit 16, upon receiving mobile data from mobile sensor 10, transmits the mobile data and a mobile unit identifiers to center server 22 by way of communication unit 14. Further, upon receiving information from verification server 52 by way of communication unit 14, control unit 16 displays this information on display unit 15.

Center server 22 is an information processor such as a workstation server and is provided in data processing center 20.

Center server 22, upon receiving mobile data and a mobile unit identifier from each portable information terminal 12, edits the collected mobile data to create edited data.

The edited data differ for each server to which the edited data are distributed. First edited data, which are data that are distributed to traffic information provider server 32, are information regarding the vehicle position and speed of each mobile unit. Second edited data, which are data that are distributed to commute route information provider server 42, are information on the vehicle position and speed of each mobile unit. The type of edited data that are sent to each server is registered in advance in a program of center server 22.

Center server 22 further stores the server identifiers that serve as addresses when transmitting edited data to servers. Similar to mobile unit identifiers, the server identifiers differ for each server.

Center server 22 transmits first edited data to traffic information provider server 32. Center server 22 further transmits second edited data, mobile unit identifiers, and the server identifier that indicates the address of commute route information provider server 42 to verification server 52.

Traffic information provider server 32 is an information processor such as a workstation server and is provided in traffic information provider facility that serves as the first information provider facility. Traffic information provider server 32 stores map information in advance.

Upon receiving first edited data from center server 22, traffic information provider server 32 stores the first edited data, and then writes information on the vehicle position and speed that have been read from the first edited data into the map information to produce condition information that indicates states such as traffic congestion or road work, and processes this condition information to a form that can be viewed by way of communication network 100 to make the information accessible from nonspecific information terminals (not shown in the figure).

Verification server 52 is an information processor such as a workstation server and is provided in mobile unit identifier/private information verification center 50.

Mobile unit owners operate manipulation units 17 of portable information terminals 12 to access verification server 52 by way of communication network 100 and register private information, and verification server 52 thus stores the private information. In addition, mobile unit owners are also able to access verification server 52 in the same way as when registering to deleting their own private information from verification server 52. The private information include the names, addresses, blood types, likes, hobbies, interests, commuting routes, and mobile unit identifiers of the mobile unit owners.

Verification server 52, upon receiving second edited data, mobile unit identifiers and server identifiers from center server 22, uses the mobile unit identifiers as a search condition to read private information and transmits the second edited data and private information to commute route information provider server 42 that is indicated by the server identifier.

Commute route information provider server 42, is an information processor such as a workstation server, and is provided in commute route information provider facility 40 that serves as the second information provider facility. Commute route information provider server 42 stores map information in advance.

Commute route information provider server 42, upon receiving the second edited data and private information from verification server 52, stores these data and information and then reads the vehicle positions and speeds from the second edited data and writes these data into the map information to create condition information that indicates states such as traffic congestion or road work. In addition, when reading information on commute routes from the private information, commute route information provider server 42 further reads from the condition information the portions that pertain to the commute routes and transmits the condition information to portable information terminals 12 that are specified by the mobile unit identifiers that were included in the received private information.

Figure 3:
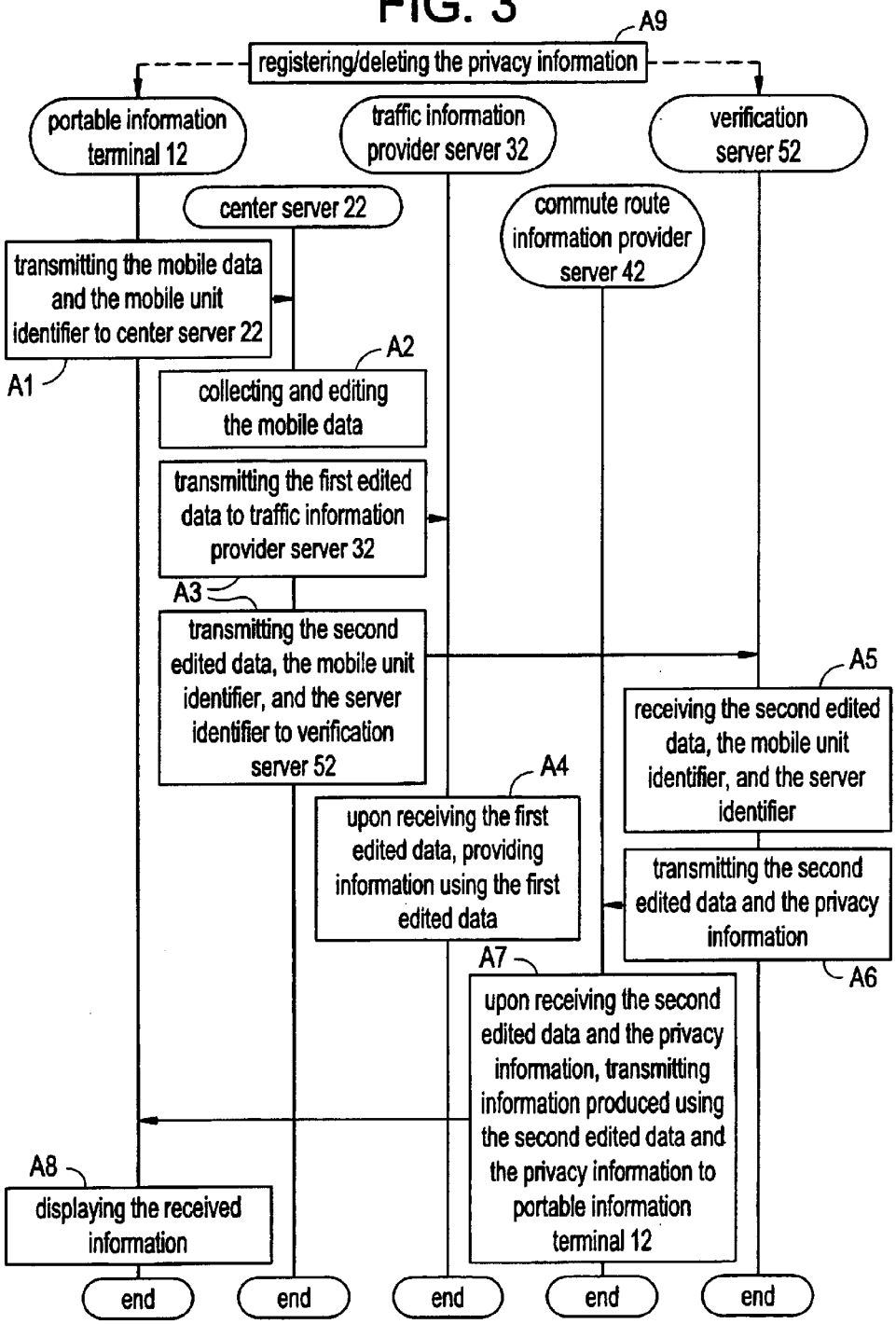
FIG. 3 is a flow chart showing the operating procedures of the embodiment of the data processing system of the present invention.

We next refer to FIG. 3, which is a flow chart showing the operating procedures of the data processing system, to explain the details of the procedures of the data processing system.

Portable information terminal 12 is activated when the owner of an automobile starts the engine. Control unit 16 of portable information terminal 12 activates mobile sensor 10, and upon receiving mobile data from mobile sensor 10, transmits the mobile data to center server 22 by way of communication unit 14 and communication network 100 (Step A1).

Center server 22, upon receiving mobile data and mobile unit identifiers from each portable information terminal 12, creates first edited data and second edited data from the collected mobile data (Step A2). Center server 22 then transmits the first edited data to traffic information provider server 32 and transmits the second edited data, mobile unit identifiers, and server identifiers to verification server 52 (Step A3).

Traffic information provider server 32, upon receiving the first edited data from center server 22, reads information on the vehicle positions and speeds from the first edited data, and creates condition information indicating states such as traffic congestion or road work. Traffic information provider server 32 then processes this condition information to a form that can be viewed by way of communication network 100 and thus makes the condition information accessible from unspecified information terminals (not shown in the figure) (Step A4).

Verification server 52, having received the second edited data, mobile unit identifiers, and server identifiers from center server 22 (Step A5), takes the mobile unit identifiers as the search conditions and reads private information for which the search conditions match. Verification server 52 then transmits the private information together with the second edited data to commute route information provider server 42 that is specified by the server identifier (Step A6).

Commute route information provider server 42, upon receiving the second edited data and private information from verification server 52, stores these data and then reads the vehicle position and speed from the second edited data, and writes these data to the map information to produce condition information that indicates states such as traffic congestion or road work. Commute route information provider server 42 then reads the information on the commute route from the private information, reads the portion of the condition information that pertains to the commute route that has been read, and transmits this condition information to portable information terminal 12 that is specified by the mobile unit identifier that is contained in the received private information (Step A7).

Portable information terminal 12, upon receiving the condition information from commute route information provider server 42 by way of verification server 52 and communication network 100, displays the condition information on display unit 15 (Step A8).

A mobile unit owner can register or delete private information by operating manipulation unit 17 of portable information terminal 12 to access verification server 52 by way of communication network 100 (Step A9).

Further, when the above-described second edited data include information such as the ambient temperature and ambient humidity, above-described commute route information provider server 42, upon receiving second edited data and private information from verification server 52, may read the ambient temperature and ambient humidity from the second edited data, produce weather information in which data on the temperature and humidity are written into the map information, and transmit weather information that pertains to the commute route that is included in the private information to portable information terminal 12 that is specified by mobile unit identifier.

In addition, the route that a mobile unit owner has registered in verification server 52 in advance is not limited to the above-described commute route, but may include routes for which the mobile unit owner wishes to acquire condition information.

As described in the foregoing explanation, private information is managed by verification server 52, and center server 22 that collects and edits mobile data is therefore relieved of the burden for information security. In addition, verification server 52 distributes the private information directly to commute route information provider server 42, and the danger that private information will be disclosed to communication network 100 can therefore be reduced.

Further, the first information provider facility and the second information provider facility are not limited to one each, as in the present embodiment, but may each include a plurality of facilities.

In addition, if the second information provider facility is a destination information provider facility, the edited data that the destination information provider server, which is the second information provider server, receives from center server 22 is information on the vehicle position, and the destination information provider server stores in advance map information in which the locations of destinations such as stores or entertainment facilities are described. The destination information provider server, upon receiving information on the vehicle position as edited data from center server 22, reads the objects of interest such as the likes, interests and hobbies of the private information, operates similarly to Step A7 shown in FIG. 3, and transmits to portable information terminal 12 the location information of sites that deal with the objects of interest of the mobile unit owner and that are within a prescribed distance of the vehicle position.

Thus, the mobile unit owner can, by registering his or her objects of interest in verification server 52 in advance, obtain location information of sites that deal with the objects of his or her interests for each destination of the mobile unit. In addition, since the danger of disclosing private information by way of communication network 100 has been reduced as described in the foregoing explanation, disclosure of the information regarding his or her objects of interest can be prevented.

In addition, if the second information provider facility is a driving technique diagnosis facility, the edited data that the driving technique diagnosis server, which is the second information provider server, received from center server 22 is information on brake control signals, and the driving technique diagnosis server stores in advance diagnosis data for diagnosing the driving technique based on brake control signals. The driving technique diagnosis server, upon receiving information on the brake control signals as edited data from center server 22, uses the above-described diagnosis data on these brake control signals to diagnose driving technique and produce driving technique diagnosis information, and transmits this driving technique diagnosis information to portable information terminal 12 that is specified by the mobile unit identifier that is contained in the private information.

In this way, the mobile unit owner, by registering a mobile unit identifier in verification server 52 in advance, can obtain driving technique diagnosis information at portable information terminal 12 of the mobile unit. Further, even when a mobile unit identifier is not registered in the private information, the driving technique diagnosis server may also specify the transmission destination of the driving technique diagnosis information based on the mobile unit identifier that is received from center server 22 by way of verification server 52.

Further, when the second information provider facility is a facility for communicating with a public facility in the event of damage such as an accident or theft, the edited data that are received from center server 22 by the damage communication server, which is the second information provider server, is information on the damage and the vehicle position. The damage communication server stores contact information for prescribed public facilities in advance, and upon receiving information on damage and vehicle position as edited data from center server 22, reads the name of the mobile unit owner from the private information, and reports the name and vehicle position information to the necessary public facility as voice data by way of a telephone line. In addition, in order to transmit the damage information contained in the mobile data to center server 22, sensors may be provided for detecting vehicle abnormalities such as a door closure abnormality or a collision detection abnormality, or a button for reporting a theft or accident may be provided in manipulation unit 17 of portable information terminal 12. Still further, when reporting to a prescribed public facility, the damage communication server is not restricted to the above-described voice data but may also report by email by way of communication network 100.

Thus, by registering his or her name in verification server 52 in advance, the owner of a mobile unit can more expeditiously report his or her name to the necessary public facility in the event of an accident or theft of the mobile unit. In addition, since the danger of disclosing private information by way of communication network 100 has been reduced as described in the foregoing explanation, the disclosure of information such as a user's name can be prevented. Finally, although the public facility that is the communication destination may be, for example, the police or fire department, the communication destination is not restricted to a public facility and may also be a security company or an insurance company.

While preferred embodiments of the present invention have been described using specific terms, such description is for illustrative purposes only, and it is to be understood that changes and variations may be made without departing from the spirit or scope of the following claims.

What is claimed is:

1. A data processing system, comprising:

portable information terminals that are provided in mobile units for transmitting, to the outside by way of a communication network, mobile data detected by mobile sensors that are provided in said mobile units, and mobile unit identifiers;

a center server for saving in advance server identifiers for specifying transmission destinations of information, and for, upon receiving said mobile data and said mobile unit identifiers from said portable information terminals, transmitting edited data that have been produced from said mobile data by said center server, said server identifiers that are the transmission destinations of said edited data, and said mobile unit identifiers to the outside by way of said communication network; and a verification server for storing in advance private information that includes said mobile unit identifiers, and for, upon receiving said edited data, said server identifier and said mobile unit identifiers from said center server, transmitting said private information that is specified by matching of the received mobile unit identifiers with mobile unit identifiers that are included in said private information and said edited data to a transmission destination that is specified by said server identifier by way of a communication line.

2. A data processing system according to claim 1, wherein:

said mobile data include information of the vehicle position and speed of said mobile unit;

said edited data include information of said vehicle position and said speed;

said private information includes information of a route that is registered by the owner of said mobile unit; and an information provider server that is the transmission destination that is specified by said server identifier is provided for storing map information in advance, and for, upon receiving said edited data and specified private information from said verification server, transmitting by way of said communication network to the portable information terminal that is identified by the mobile unit identifier that is included in the specified private information, of condition information obtained by writing information of said vehicle position and said speed that has been read from said edited data into said map information, condition information that pertains to said registered route that is included in specified private information.

3. A data processing system according to claim 1, wherein:

said mobile data include information on the vehicle position of said mobile unit;

said edited data include information of said vehicle position;

said private information includes information on objects of interest of the owner of said mobile unit such as likes, interests, hobbies, and pastimes; and an information provider server that is the transmission destination that is specified by a server identifier is provided for storing map information in advance and for, upon receiving said edited data and specified private information from said verification server, reading from said map information location information of sites that deal with said objects of interest that have been read from specified private information and that are within a prescribed distance from said vehicle position that has been read from said edited data; and transmitting this location information by way of said communication network to the portable information terminal that is identified by the mobile unit identifier that is included in the specified private information.

4. A data processing system according to claim 1, wherein:

said mobile data include information of the vehicle position of said mobile unit as well as information on damage such as a theft or an accident that has occurred in said mobile unit;

said edited data include information of said vehicle position and said damage;

said private information includes information of the name of the owner of said mobile unit; and an information provider server that is the transmission destination that is specified by said server identifier is provided for storing in advance contact information of a prescribed facility that must be contacted in the event of said damage, and for, upon receiving said edited data and specified private information from said verification server, reporting to said prescribed facility information of said vehicle position that has been read from said edited data and information on said names that is read from the specified private information.

5. A verification server for storing private information that includes mobile unit identifiers in advance; and, upon receiving edited data, server identifiers, and mobile unit identifiers from a center server, transmitting said edited data and said private information that is specified by matching between the received mobile unit identifiers and mobile unit identifiers that are contained in said private information to transmission destinations that are specified by said server identifiers by way of a communication line.

6. A data processing method that is realized by a data processing system that comprises portable information terminals that are provided in mobile units and a center server that is connected to these portable information terminals by way of a communication network so as to allow communication; the data processing method comprising:

providing the data processing system with a verification server that is connected to said center server by way of said communication network for storing in advance private information that includes mobile unit identifiers of said mobile units;

storing in said center server server identifiers for specifying the transmission destinations of information;

producing edited data from said mobile data upon receiving from said portable information terminals mobile data, which is detected by mobile sensors that are provided in said mobile units, and mobile unit identifiers of said mobile units;

transmitting said edited data, said server identifiers that are the transmission destinations of the edited data, and said mobile unit identifiers to said verification server; and transmitting by way of a communication line to transmission destinations that are specified by said server identifiers said edited data and private information that is specified by matching between the received mobile unit identifiers and mobile unit identifiers that are contained in said private information upon receiving said edited data, said server identifiers, and said mobile unit identifiers from said center server.

7. A data processing method according to claim 6, wherein:

said mobile data include information of the vehicle position and speed of said mobile unit;

said edited data include information of said vehicle position and said speed;

said private information includes information on a route that is registered by the owner of said mobile unit; and an information provider server that is the transmission destination that is specified by said server identifier is provided for storing map information in advance;

said information provider server, upon receiving specified private information and said edited data from said verification server, transmitting by way of said communication network to the portable information terminal that is identified by the mobile unit identifier that is contained in the specified private information, of condition information obtained by writing information of said vehicle position and said speed that has been read from said edited data into said map information, said condition information that pertains to said route that was registered and that is included in specified private information.

8. A data processing method according to claim 6, wherein:

said mobile data include information of the vehicle position of said mobile unit;

said edited data include information of said vehicle position;

said private information includes information of objects of interest of the owner of said mobile unit such as likes, interests, hobbies and pastimes;

an information provider server that is the transmission destination that is specified by said server identifier is provided for storing map information in advance;

said information provider server, upon receiving said edited data and specified private information from said verification server, reading from said map information location information of sites that deal with said objects of interest that have been read from the specified private information and that are within a prescribed distance from said vehicle position that has been read from said edited data, and transmitting these location data by way of said communication network to the portable information terminal that is identified by the mobile unit identifier that is contained in the specified private information.

9. A data processing method according to claim 6, wherein:

said mobile data include the vehicle position of said mobile unit as well as information of damage such as a theft or an accident that has occurred in said mobile unit;

said edited data include said vehicle position and said information of damage;

said private information includes information of the name of the owner of said mobile unit; and an information provider server that is the transmission destination that is specified by said server identifier is provided for storing in advance contact information of a prescribed facility that must be contacted in the event of said damage;

said information provider server, upon receiving said edited data and specified private information from said verification server, reporting to said prescribed facility said vehicle position that has been read from said edited data and said name information that has been read from the specified private information.

* * * * *